US011229928B2

(12) United States Patent
Inagaki et al.

(10) Patent No.: US 11,229,928 B2
(45) Date of Patent: Jan. 25, 2022

(54) SEPARATION DEVICE AND FIBER BODY DEPOSITION APPARATUS

(71) Applicant: SEIKO EPSON CORPORATION, Tokyo (JP)

(72) Inventors: Yuta Inagaki, Nagano (JP); Naoko Omagari, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 113 days.

(21) Appl. No.: 16/775,374

(22) Filed: Jan. 29, 2020

(65) Prior Publication Data

US 2020/0246837 A1 Aug. 6, 2020

(30) Foreign Application Priority Data

Jan. 31, 2019 (JP) ..... JP2019-016117

(51) Int. Cl.
*B07B 7/06* (2006.01)
*B07B 1/08* (2006.01)
*B07B 11/06* (2006.01)

(52) U.S. Cl.
CPC ..... *B07B 7/06* (2013.01); *B07B 1/08* (2013.01); *B07B 11/06* (2013.01)

(58) Field of Classification Search
CPC .. B07B 7/06; B07B 1/08; B07B 11/06; B07B 4/08; B07B 1/4681; B07B 1/06
See application file for complete search history.

(56) References Cited

U.S. PATENT DOCUMENTS 2,265,977 A * 12/1941 Andrews ..... B07B 4/08 209/44
3,123,551 A * 3/1964 Walker ..... B07B 4/08 209/29
3,367,502 A * 2/1968 Cravens ..... B07B 7/06 209/467
3,989,620 A * 11/1976 Stern ..... B07B 11/06 209/148
4,213,855 A 7/1980 Von Bennigsen-Mackiewicz et al.
4,485,009 A * 11/1984 Csontos ..... A61J 3/00 209/250
4,678,560 A * 7/1987 Stole ..... B07B 9/00 209/23
4,961,722 A * 10/1990 Taylor ..... B01D 29/35 494/36

(Continued)

FOREIGN PATENT DOCUMENTS

DE 964463 C 5/1957
DE 2459537 C2 8/1983

(Continued)

*Primary Examiner* — Patrick H Mackey
(74) *Attorney, Agent, or Firm* — Global IP Counselors, LLP

(57) ABSTRACT

A separation device includes a rotating member that has a mesh having a first surface and a second surface in a front and back relationship and a protruding member provided on the first surface side of the mesh, a supply unit that supplies a material containing a fiber onto the first surface of the mesh, a suction unit that is provided on the second surface side of the mesh and configured to suck a part of the material supplied onto the first surface, and a collection unit that collects the material deposited on the first surface.

8 Claims, 8 Drawing Sheets

(56) References Cited

U.S. PATENT DOCUMENTS

| | | | | | |
|---|---|---|---|---|---|
| 5,375,720 | A * | 12/1994 | Piggott | B07B 4/08 209/254 |
| 9,776,213 | B2 * | 10/2017 | Miyazawa | D21F 9/00 |
| 9,856,104 | B2 | 1/2018 | Fujita et al. | |
| 2010/0243538 | A1 | 9/2010 | Uebayashi et al. | |
| 2015/0284672 | A1 | 10/2015 | Swanda et al. | |

FOREIGN PATENT DOCUMENTS

| | | | | |
|---|---|---|---|---|
| DE | 10200842 | A1 | | 8/2002 |
| DE | 102012024266 | A1 | | 6/2014 |
| EP | 2784210 | A1 | | 10/2014 |
| JP | 07-108224 | A | | 4/1995 |
| JP | 07108224 | A | * | 4/1995 |
| JP | H10-099785 | A | | 4/1998 |
| JP | 2015-178206 | A | | 10/2015 |
| JP | 2016-098473 | A | | 5/2016 |
| JP | 2016-124211 | A | | 7/2016 |

* cited by examiner

SEPARATION DEVICE AND FIBER BODY DEPOSITION APPARATUS

The present application is based on, and claims priority from JP Application Serial Number 2019-016117, filed Jan. 31, 2019, the disclosure of which is hereby incorporated by reference herein in its entirety.

BACKGROUND

1. Technical Field

The present disclosure relates to a separation device and a fiber body deposition apparatus.

2. Related Art

In the related art, a removal device that removes foreign matter and the like in supplied material is known (see, for example, JP-A-7-108224).

As shown in FIG. 1 of JP-A-7-108224, a separation device includes a disc-shaped belt screen 1, an ejection port 2 provided on one surface side of the belt screen 1, a suction port 3 provided on the opposite side of the ejection port 2 via the belt screen 1, an ejection port 4 provided on the other surface side of the belt screen 1 and at a position different from the suction port 3, and a suction port 5 provided on the opposite side of the ejection port 4 via the belt screen 1.

By supplying granular material from the ejection port 2 onto the belt screen 1 and performing suction from the suction port 3, excessively fine granular material can be removed. In this case, foreign matter in the granular material can also be removed. Further, when the belt screen 1 rotates, the granular material remaining on the belt screen 1 also moves, and at the destination, the granular material is separated from the belt screen 1 by air ejected from the ejection port 4, and the separated granular material can be collected by suction at the suction port 5.

However, in the separation device disclosed in JP-A-7-108224, depending on the suction force of the suction port 5, even if the belt screen 1 rotates, the granular material remains in place, and there is a possibility that the granular material cannot be transported to the position where the ejection port 4 and the suction port 5 are installed. That is, there is a possibility that collection of the granular material cannot be satisfactorily performed.

SUMMARY

The present disclosure can be realized in the following aspect.

According to an aspect of the present disclosure, there is provided a separation device. The separation device includes a rotating member that has a mesh having a first surface and a second surface in a front and back relationship and a protruding member provided on the first surface side of the mesh, a supply unit that supplies a material containing a fiber onto the first surface of the mesh, a suction unit that is provided on the second surface side of the mesh and configured to suck a part of the material supplied onto the first surface, and a collection unit that collects the material deposited on the first surface.

According to another aspect of the present disclosure, there is provided a separation device. The separation device includes a rotatable rotating member that has a mesh having a first surface and a second surface in a front and back relationship and a protruding member provided on the second surface side of the mesh and causing the mesh to protrude toward the first surface side, a supply unit that supplies a material containing a fiber onto the first surface of the mesh, a suction unit that is provided on the second surface side of the mesh and sucks a part of the material supplied onto the first surface, and a collection unit that collects the material deposited on the first surface.

According to still another aspect of the present disclosure, there is provided a fiber body deposition apparatus. The fiber body deposition apparatus includes the separation device according to the present disclosure and a deposition unit that deposits the material collected by the collection unit to form a web.

DESCRIPTION OF EXEMPLARY EMBODIMENTS

Hereinafter, a separation device and a fiber body deposition apparatus according to the present disclosure will be described in detail with reference to a preferred embodiment shown in the accompanying drawings.

First Embodiment

Figure 1:
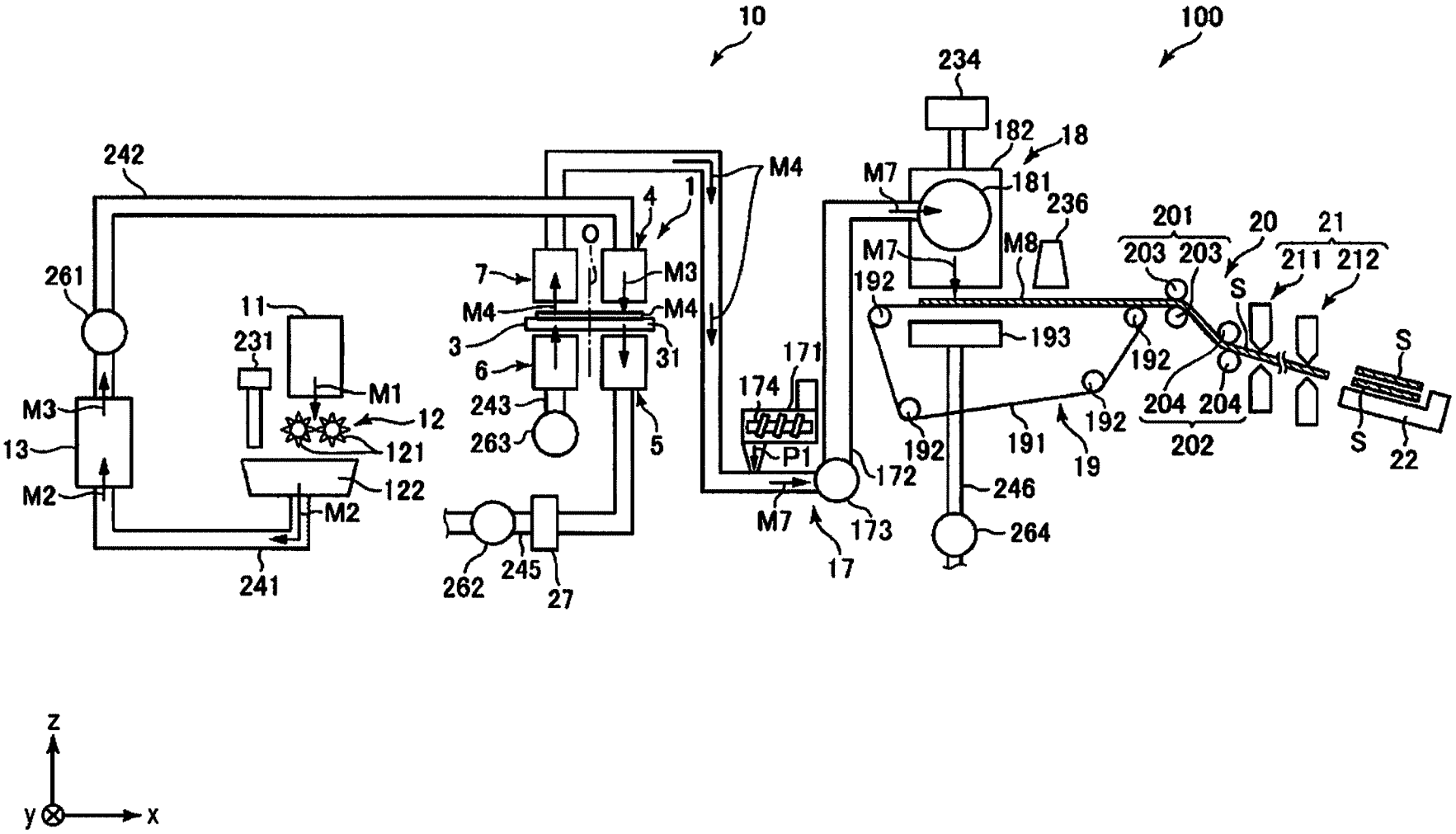
FIG. 1 is a schematic side view showing a sheet manufacturing apparatus including a separation device and a fiber body deposition apparatus according to a first embodiment of the present disclosure.
Figure 2:
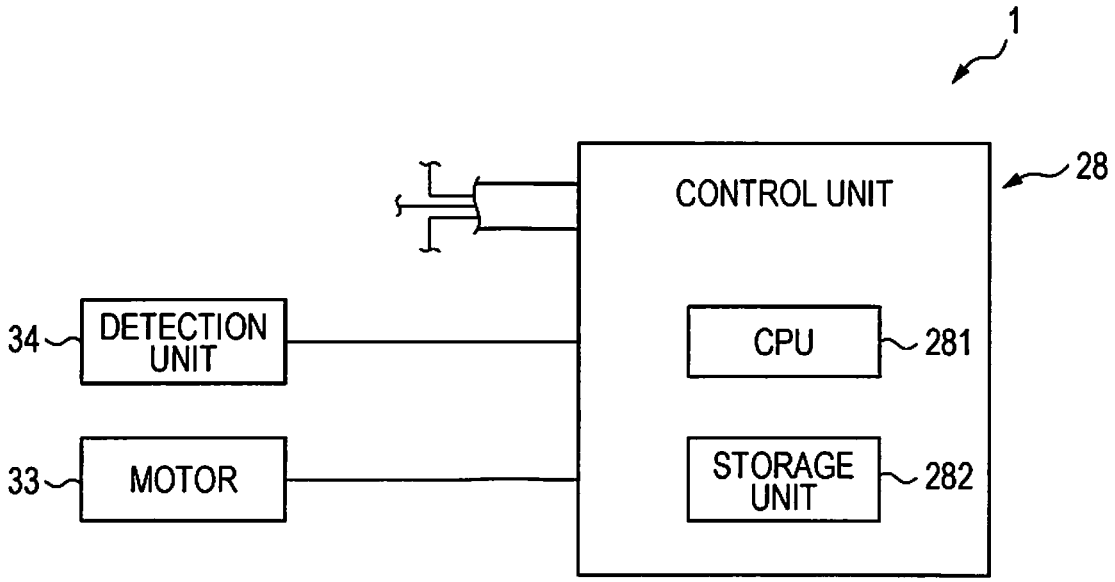
FIG. 2 is a block diagram of the sheet manufacturing apparatus shown in FIG. 1.
Figure 3:
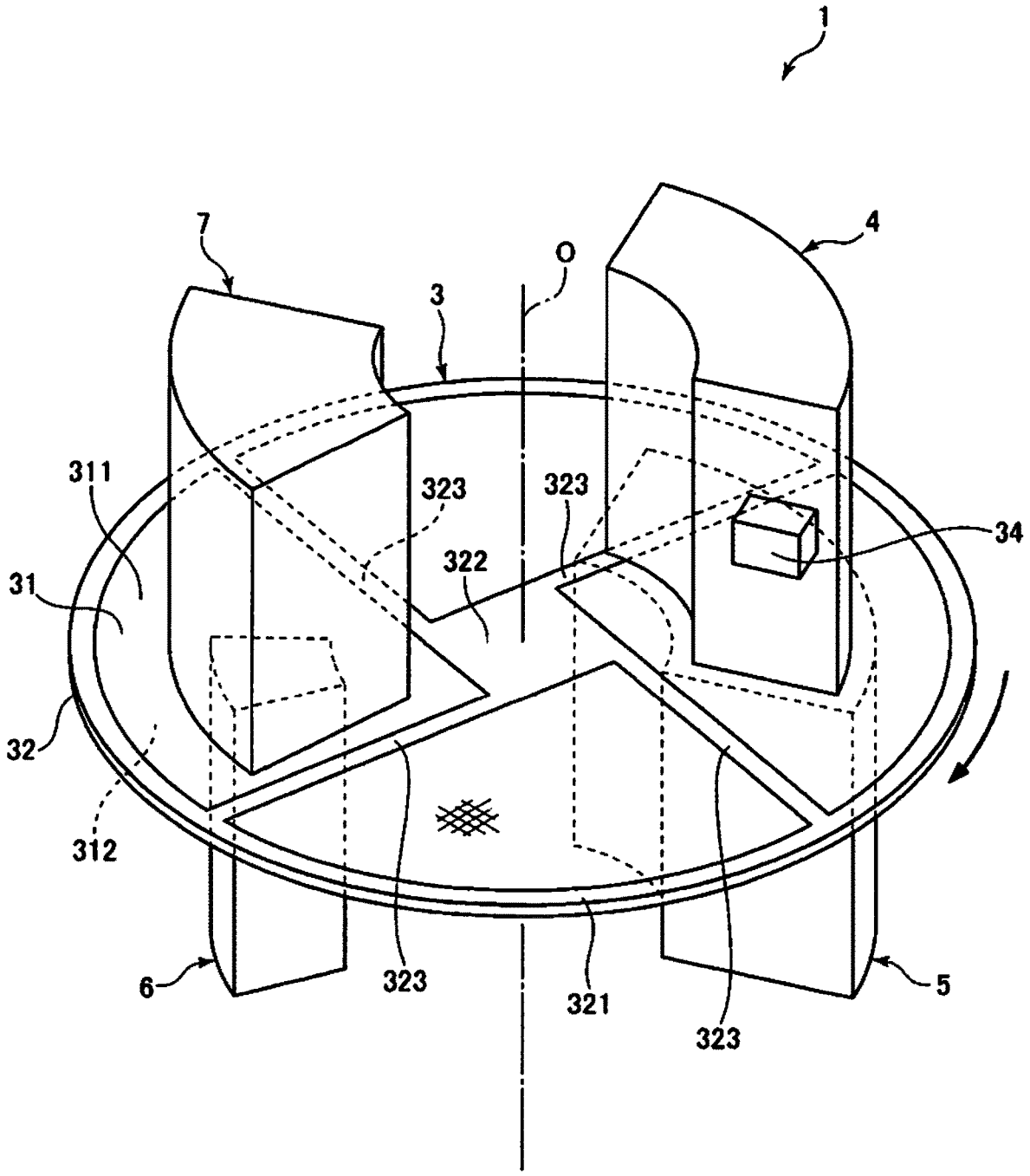
FIG. 3 is a perspective view of the separation device shown in FIG. 1.
Figure 4:
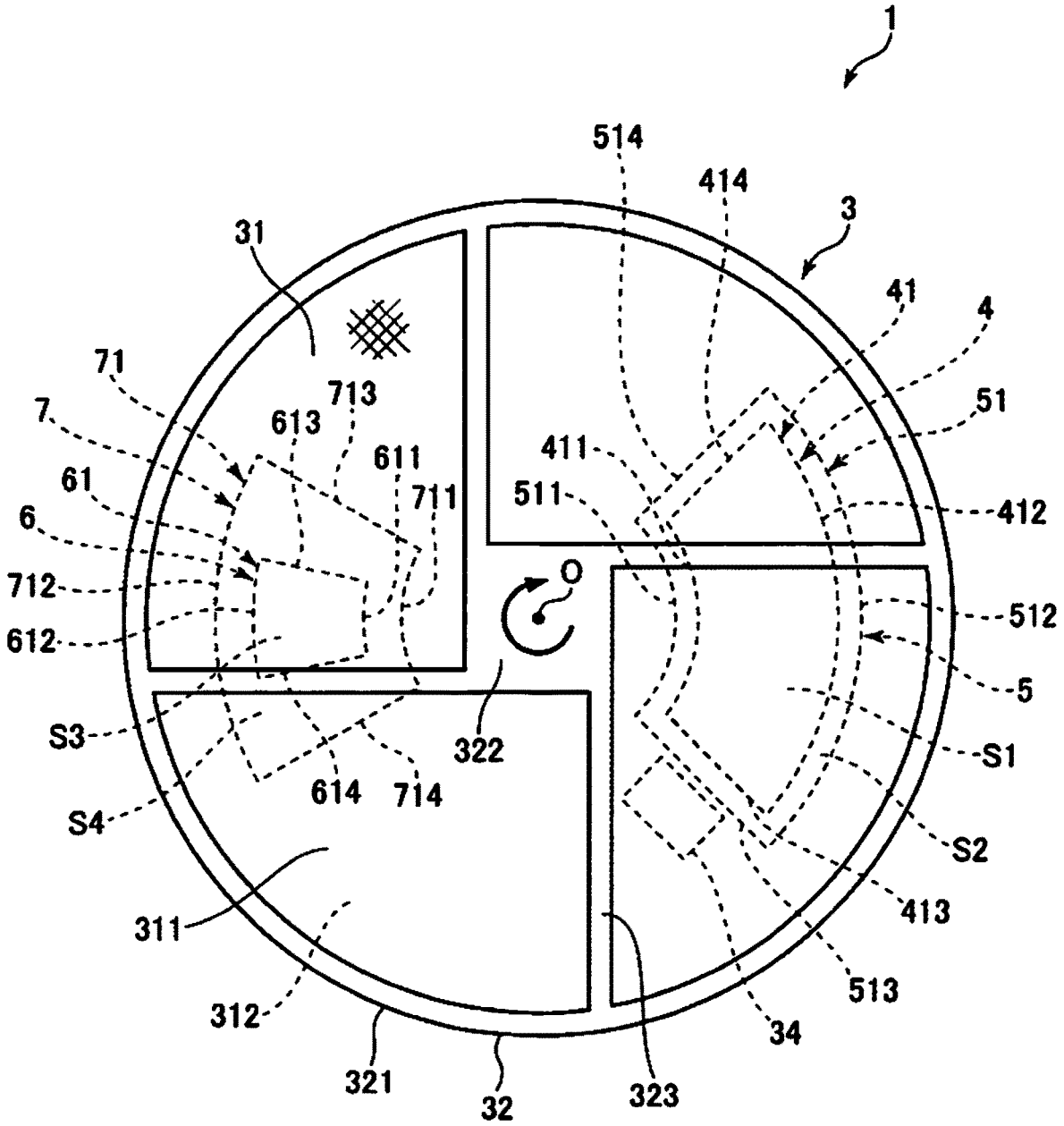
FIG. 4 is a plan view of the separation device shown in FIG. 3.
Figure 5:
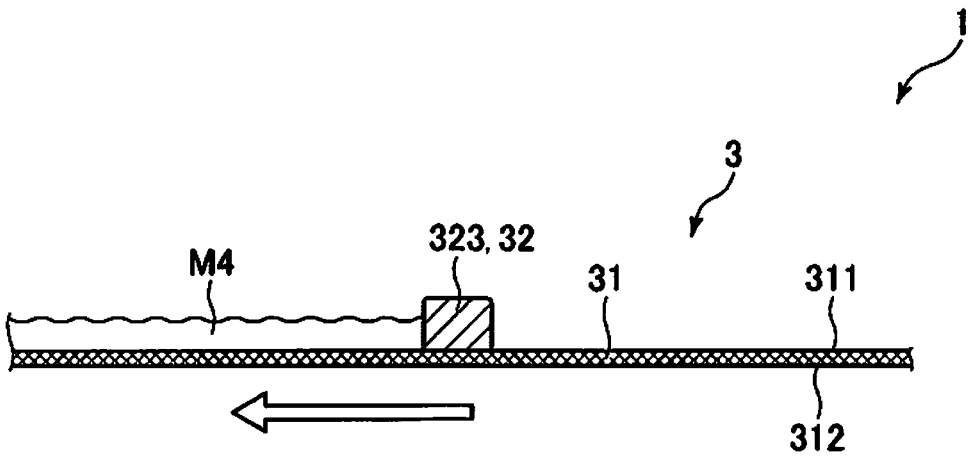
FIG. 5 is a side view of the separation device shown in FIG. 3.
Figure 6:
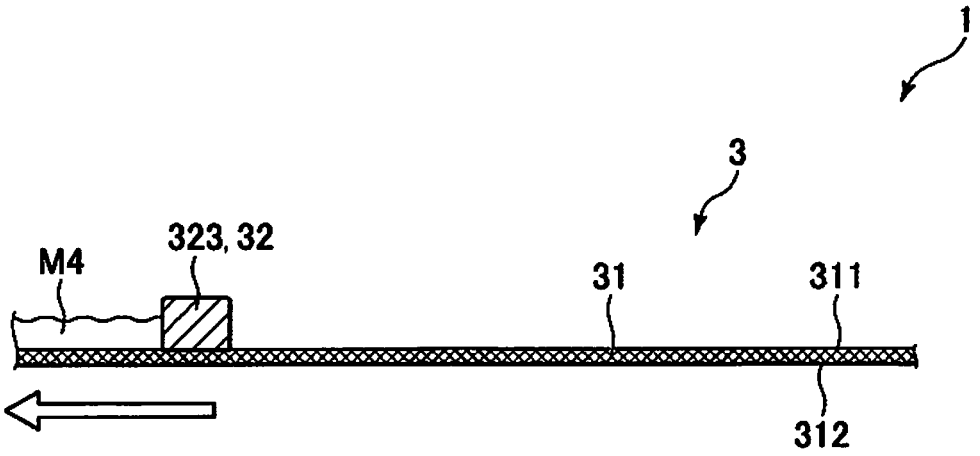
FIG. 6 is a side view of the separation device shown in FIG. 3.

FIG. 1 is a schematic side view showing a sheet manufacturing apparatus including a separation device and a fiber body deposition apparatus according to a first embodiment of the present disclosure. FIG. 2 is a block diagram of the sheet manufacturing apparatus shown in FIG. 1. FIG. 3 is a perspective view of the separation device shown in FIG. 1. FIG. 4 is a plan view of the separation device shown in FIG. 3. FIGS. 5 and 6 are side views of the separation device shown in FIG. 3.

In the following, for convenience of description, as shown in FIG. 1, three axes orthogonal to each other are referred to as an x-axis, a y-axis, and a z-axis. Further, an xy plane including the x axis and the y axis is horizontal, and the z axis is vertical. The direction in which the arrow of each axis is directed is referred to as "+", and the opposite direction is referred to as "−". In FIGS. 1, 3, 5 and 6 (the same applies to FIGS. 7 and 8), an upper side may be referred to as "up" or "above", and a lower side may be referred to as "down" or "below". Further, the direction in which the material is transported is referred to as downstream, and the opposite side is referred to as upstream.

As shown in FIG. 1, a sheet manufacturing apparatus 100 includes a raw material supply unit 11, a crushing unit 12, a defibrating unit 13, a separation device 1 according to the present disclosure, a mixing unit 17, a loosening unit 18, a web forming unit 19, a sheet forming unit 20, a cutting unit 21, a stock unit 22, a collection unit 27, and a control unit 28. Further, each of the units is electrically coupled to the control unit 28, and the operation thereof is controlled by the control unit 28. Note that, the separation device 1 and the web forming unit 19 constitute a fiber body deposition apparatus 10 according to the present disclosure.

Further, the sheet manufacturing apparatus 100 includes a humidifying unit 231, a humidifying unit 234, and a humidifying unit 236. In addition, the sheet manufacturing apparatus 100 includes a blower 261, a blower 262, a blower 263, and a blower 264.

Further, in the sheet manufacturing apparatus 100, a raw material supply process, a crushing process, a defibration process, a separation process, a mixing process, a loosening process, a web forming process, a sheet forming process, and a cutting process are executed in this order.

Hereinafter, the configuration of each unit will be described.

The raw material supply unit 11 performs the raw material supply process which supplies a raw material M1 to the crushing unit 12. The raw material M1 is a sheet-like material which consists of a fiber-containing material containing a cellulose fiber. The cellulose fiber is not particularly limited as long as it is mainly composed of cellulose as a compound and has a fibrous shape, and the fiber may contain hemicellulose and lignin in addition to cellulose. Further, the raw material M1 may be in any form such as woven fabric or non-woven fabric. The raw material M1 may be, for example, recycled paper that is recycled and manufactured by defibrating used paper or YUPO paper (registered trademark) that is synthetic paper, or may not be recycled paper. In the present embodiment, the raw material M1 is used paper that has been used or that is no longer needed.

The crushing unit 12 performs a crushing process of crushing the raw material M1 supplied from the raw material supply unit 11 in the atmosphere or the like. The crushing unit 12 has a pair of crushing blades 121 and a chute 122.

The pair of crushing blades 121 can rotate in mutually opposite directions to crush the raw material M1 between the crushing blades, that is, cut the raw material to form a crushing piece M2. The shape and size of the crushing piece M2 may be suitable for a defibrating process in the defibrating unit 13, are preferably a small piece having a side length of 100 mm or less, and more preferably a small piece having a side length of 10 mm or more and 70 mm or less, for example.

The chute 122 is disposed below the pair of crushing blades 121 and has, for example, a funnel shape. Thereby, the chute 122 can receive the crushing piece M2 which is crushed by the crushing blade 121 and fell.

Further, the humidifying unit 231 is disposed above the chute 122 so as to be adjacent to the pair of crushing blades 121. The humidifying unit 231 humidifies the crushing piece M2 in the chute 122. The humidifying unit 231 has a filter (not shown) containing moisture, and includes a vaporization type or hot air vaporization type humidifier that supplies humidified air with increased humidity to the crushing piece M2 by passing air through the filter. By supplying the humidified air to the crushing piece M2, it is possible to prevent the crushing piece M2 from adhering to the chute 122 and the like due to static electricity.

The chute 122 is coupled to the defibrating unit 13 via a pipe 241. The crushing piece M2 collected on the chute 122 passes through the pipe 241 and is transported to the defibrating unit 13.

The defibrating unit 13 performs a defibrating process of defibrating the crushing piece M2 in the air, that is, in a dry manner. By the defibrating process in the defibrating unit 13, a defibrated material M3 can be generated from the crushing piece M2. Here, "defibrating" means unraveling the crushing piece M2 formed by binding a plurality of fibers into individual fibers. Then, the unraveled material is the defibrated material M3. The shape of the defibrated material M3 is linear or band shape. Further, the defibrated material M3 may exist in a state where the defibrated material is entangled and formed into a lump, that is, in a state of forming a so-called "ball".

In the present embodiment, for example, the defibrating unit 13 includes an impeller mill having a rotor that rotates at a high speed and a liner that is positioned on the outer periphery of the rotor. The crushing piece M2 flowing into the defibrating unit 13 is defibrated by being sandwiched between the rotor and the liner.

Further, the defibrating unit 13 can generate a flow of air from the crushing unit 12 toward the separation device 1, that is, an air flow, by rotation of the rotor. Thereby, it is possible to suck the crushing piece M2 to the defibrating unit 13 from the pipe 241. After the defibrating process, the defibrated material M3 can be sent out to the separation device 1 via the pipe 242.

The blower 261 is installed in the middle of the pipe 242. The blower 261 is an air flow generation device that generates an air flow toward the separation device 1. Thereby, sending out the defibrated material M3 to the separation device 1 is promoted.

The separation device 1 is a device that performs a separation process of selecting the defibrated material M3 based on the length of the fiber and removing foreign matter in the defibrated material M3. The configuration of the separation device 1 will be described in detail later. The defibrated material M3 becomes a defibrated material M4 from which foreign matter such as coloring material is removed by passing through the separation device 1, and which includes fibers having a length equal to or longer than a predetermined length, that is, fibers having a length suitable for sheet manufacturing. The defibrated material M4 is sent out to the mixing unit 17 on the downstream.

The mixing unit 17 is disposed downstream of the separation device 1. The mixing unit 17 performs the mixing process which mixes the defibrated material M4 and a resin P1. The mixing unit 17 has a resin supply unit 171, a pipe 172, and a blower 173.

The pipe 172 couples a second suction unit 7 of the separation device 1 and a housing unit 182 of the loosening unit 18 to each other and is a flow path through which a mixture M7 of the defibrated material M4 and the resin P1 passes.

The resin supply unit 171 is coupled in the middle of the pipe 172. The resin supply unit 171 has a screw feeder 174. When the screw feeder 174 is rotationally driven, the resin P1 can be supplied to the pipe 172 as powder or particles.

The resin P1 supplied to the pipe 172 is mixed with the defibrated material M4 to become the mixture M7.

The resin P1 is obtained by binding the fibers in a later process, and for example, a thermoplastic resin, a curable resin, or the like can be used, but a thermoplastic resin is preferably used. Examples of the thermoplastic resin include an AS resin, an ABS resin, polyethylene, polypropylene, polyolefin such as an ethylene-vinyl acetate copolymer (EVA), modified polyolefin, an acrylic resin such as polymethyl methacrylate, polyvinyl chloride, polystyrene, polyester such as polyethylene terephthalate and polybutylene terephthalate, polyamide (nylon) such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyetheretherketone, polycarbonate, polyphenylene sulfide, thermoplastic polyimide, polyetherimide, a liquid crystal polymer such as aromatic polyester, various thermoplastic elastomers such as a styrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, a polyamide-based thermoplastic elastomer, a polybutadiene-based thermoplastic elastomer, a trans polyisoprene-based thermoplastic elastomer, a fluoro rubber-based thermoplastic elastomer, and a chlorinated polyethylene-based thermoplastic elastomer, and the like, and one or more selected from these can be used in combination. Preferably, as the thermoplastic resin, polyester or a composition containing the polyester is used.

In addition to the resin P1, a colorant for coloring the fiber, an aggregation inhibitor for inhibiting aggregation of the fiber or aggregation of the resin P1, a flame retardant for making the fiber difficult to burn, a paper strengthening agent for enhancing the paper strength of sheet S, and the like may be supplied from the resin supply unit 171. Alternatively, the above-mentioned colorant, aggregation inhibitor, flame retardant, and paper strengthening agent are contained and compounded in the resin P1 in advance, and then the resultant may be supplied from the resin supply unit 171.

In the middle of the pipe 172, the blower 173 is installed downstream of the resin supply unit 171. The defibrated material M4 and the resin P1 are mixed by the action of a rotating portion such as a blade of the blower 173. Further, the blower 173 can generate an air flow toward the loosening unit 18. With the air flow, the defibrated material M4 and the resin P1 can be stirred in the pipe 172. Thereby, the mixture M7 can flow into the loosening unit 18 in a state where the defibrated material M4 and the resin P1 are uniformly dispersed. Further, the defibrated material M4 in the mixture M7 is loosened in the process of passing through the pipe 172, and has a finer fibrous shape.

The loosening unit 18 performs the loosening process of loosening the mutually entangled fibers in the mixture M7. The loosening unit 18 includes a drum unit 181 and the housing unit 182 that houses the drum unit 181.

The drum unit 181 is a sieve that is formed of a cylindrical net body and that rotates around its central axis. The mixture M7 flows into the drum unit 181. When the drum unit 181 rotates, fibers or the like smaller than the opening of the net in the mixture M7 can pass through the drum unit 181. At that time, the mixture M7 is loosened.

The housing unit 182 is coupled to the humidifying unit 234. The humidifying unit 234 includes a vaporization type humidifier similar to the humidifying unit 231. Thereby, the humidified air is supplied into the housing unit 182. The inside of the housing unit 182 can be humidified with the humidified air, so that the mixture M7 can be prevented from adhering to the inner wall of the housing unit 182 by electrostatic force.

Further, the mixture M7 loosened in the drum unit 181 falls while being dispersed in the air, and travels to the web forming unit 19 located below the drum unit 181. The web forming unit 19 performs the web forming process of forming a web M8 from the mixture M7. The web forming unit 19 has a mesh belt 191, a tension roller 192, and a suction unit 193.

The mesh belt 191 is an endless belt, and the mixture M7 is deposited thereon. The mesh belt 191 is wound around four tension rollers 192. When the tension rollers 192 are rotationally driven, the mixture M7 on the mesh belt 191 is transported toward downstream.

Further, most of the mixture M7 on the mesh belt 191 has a size equal to or larger than the opening of the mesh belt 191. Thereby, the mixture M7 is restricted from passing through the mesh belt 191 and can thus be deposited on the mesh belt 191. Since the mixture M7 is transported toward downstream with the mesh belt 191 in a state where the mixture is deposited on the mesh belt 191, the mixture is formed as the layered web M8.

The suction unit 193 is a suction mechanism that sucks air from below the mesh belt 191. Thereby, the mixture M7 can be sucked onto the mesh belt 191, and thus the deposition of the mixture M7 onto the mesh belt 191 is promoted.

A pipe 246 is coupled to the suction unit 193. Further, the blower 264 is installed in the middle of the pipe 246. By the operation of the blower 264, a suction force can be generated at the suction unit 193.

The humidifying unit 236 is disposed downstream of the loosening unit 18. The humidifying unit 236 includes an ultrasonic humidifier. Thereby, moisture can be supplied to the web M8, and thus the content of moisture of the web M8 is adjusted. By the adjustment, adsorption of the web M8 to the mesh belt 191 due to electrostatic force can be suppressed. Thereby, the web M8 is easily peeled from the mesh belt 191 at a position where the mesh belt 191 is folded back by the tension roller 192.

The total content of moisture added from the humidifying unit 231 to the humidifying unit 236 is preferably 0.5 parts by mass or more and 20 parts by mass or less with respect to 100 parts by mass of the material before humidification, for example.

The sheet forming unit 20 is disposed downstream of the web forming unit 19. The sheet forming unit 20 performs the sheet forming process of forming the sheet S from the web M8. The sheet forming unit 20 has a pressurizing unit 201 and a heating unit 202.

The pressurizing unit 201 has a pair of calender rollers 203 and can pressurize the web M8 between the calender rollers 203 without heating the web M8. Thereby, the density of the web M8 is increased. As an extent of the heating in this case, for example, it is preferable that the resin P1 is not melted. The web M8 is transported toward the heating unit 202. Note that, one of the pair of calender rollers 203 is a main driving roller which is driven by the operation of a motor (not shown), and the other is a driven roller.

The heating unit 202 has a pair of heating rollers 204 and can pressurize the web M8 between the heating rollers 204 while heating the web M8. By the heat and pressure, the resin P1 is melted in the web M8, and the fibers are bound to each other via the melted resin P1. Thereby, the sheet S is formed. The sheet S is transported toward the cutting unit 21. Note that, one of the pair of heating rollers 204 is a main driving roller which is driven by the operation of the motor (not shown), and the other is a driven roller.

The cutting unit 21 is disposed downstream of the sheet forming unit 20. The cutting unit 21 performs the cutting process of cutting the sheet S. The cutting unit 21 has a first cutter 211 and a second cutter 212.

The first cutter 211 cuts the sheet S in a direction that intersects with the transport direction of the sheet S, particularly in a direction orthogonal thereto.

The second cutter 212 cuts the sheet S in a direction parallel to the transport direction of the sheet S on the downstream of the first cutter 211. The cutting is a process of removing unnecessary portions at both ends of the sheet S, that is, the ends in the +y axis direction and the −y axis direction to adjust the width of the sheet S. In addition, the portion that has been removed by the cutting is referred to as a so-called "edge".

By cutting the first cutter 211 and the second cutter 212 as described above, the sheet S having a desired shape and size can be obtained. The sheet S is transported further downstream and accumulated in the stock unit 22.

As shown in FIG. 2, the control unit 28 has a central processing unit (CPU) 281 and a storage unit 282. For example, the CPU 281 can make various determinations and various commands.

The storage unit 282 stores various programs, such as a program for manufacturing the sheet S.

The control unit 28 may be built in the sheet manufacturing apparatus 100 or may be provided in an external device such as an external computer. In some cases, the external device communicates with the sheet manufacturing apparatus 100 via a cable or the like, or wirelessly communicates therewith. For example, a network such as the Internet may be connected to the external device via the sheet manufacturing apparatus 100.

Further, for example, the CPU 281 and the storage unit 282 may be integrated as a single unit, the CPU 281 may be built in the sheet manufacturing apparatus 100 and the storage unit 282 may be provided in an external device such as an external computer, or the storage unit 282 may be built in the sheet manufacturing apparatus 100 and the CPU 281 may be provided in an external device such as an external computer.

Next, the separation device 1 will be described.

As shown in FIGS. 1 to 3, the separation device 1 includes a rotating member 3 having a mesh 31, a first ejection unit 4 that is a supply unit that ejects and supplies the defibrated material M3 with air onto the mesh 31, a first suction unit 5 that sucks a part of the defibrated material M3 on the mesh 31, a second ejection unit 6 that ejects air to the defibrated material M4 generated by suction, a second suction unit 7 that sucks and collects the defibrated material M4, a motor 33, and a detection unit 34 that detects the mixing amount of foreign matter. The second ejection unit 6 and the second suction unit 7 constitute a collection unit.

As shown in FIG. 3, the rotating member 3 has the mesh 31 that has a circular shape in plan view, and a support member 32 that supports the mesh 31.

The mesh 31 has the first surface 311 and a second surface 312 in a front and back relationship. In the present embodiment, the first surface 311 is an upper surface facing vertically upward, and the second surface 312 is a lower surface facing vertically downward.

The mesh 31 can be, for example, a linear body knitted in a net shape, or a disc-shaped member provided with a plurality of through holes. Of the fibers of the defibrated material M3 supplied onto the first surface 311 of the mesh 31, the fibers longer than the size of the opening of the mesh 31 remain on the mesh 31, that is, are deposited on the mesh 31, and the fibers shorter than the size of the opening of the mesh 31 or foreign matters such as coloring materials pass through the mesh 31. Then, by setting the opening of the mesh 31 to a desired size, for example, fibers having a length suitable for sheet manufacturing can be selectively left.

The support member 32 has a function of supporting the mesh 31 to maintain the flat shape of the mesh 31. In the present embodiment, the support member 32 supports the mesh 31 from the first surface 311 side of the mesh 31. At least a part of the mesh 31 and the support member 32 is fixed, and when the support member 32 is rotated by the operation of the motor 33, the mesh 31 is rotated together with the support member.

The support member 32 includes a ring-shaped frame body 321 that supports the edge of the mesh 31, a central support portion 322 that supports the center portion of the mesh 31, and a plurality of rod-like connecting portions 323 that connect the frame body 321 and the central support portion 322 to each other.

In the present embodiment, the connecting portion 323 has a straight bar shape in which the cross-sectional shape is a quadrangular prism shape. In other words, the connecting portion 323 is a long member extending across the mesh 31 from the center portion (the central support portion 322) to the outer peripheral portion (the frame body 321). Further, in the present embodiment, four connecting portions 323 are provided radially, that is, at equal intervals along the circumferential direction of the mesh 31. The shape of the connecting portion 323 is not limited to the above-described configuration, for example, any shape such as a round bar shape may be used.

Such a rotating member 3 is coupled to the motor 33 that is a rotational driving source, and can rotate around a central axis O by the operation of the motor 33. The motor 33 is configured so that the rotation speed is variable, and the operation of the motor is controlled by the control unit 28. In the present embodiment, the rotating member 3 rotates in the arrow direction in FIGS. 3 and 4, that is, in the clockwise direction when viewed from the first surface 311 side.

As described above, the mesh 31 has a circular shape in plan view and rotates around the central axis O of the circular shape. Thereby, the movement route of the defibrated material M4 can be made only on the first surface 311 of the mesh 31. Accordingly, it contributes to the downsizing of the rotating member 3 and consequently the downsizing of the separation device 1.

The first ejection unit 4 is installed on the first surface 311 side of the mesh 31. In the present embodiment, as shown in FIG. 1, the first ejection unit 4 is installed on the right side of the central axis O of the mesh 31 when viewed from the −y axis side. The first ejection unit 4 is coupled to the downstream end of the pipe 242 and has a first ejection port 41 at a position facing the first surface 311 of the mesh 31. With the air flow generated by the blower 261, the first ejection unit 4 ejects the defibrated material M3 together with the air flowed through the first ejection port 41 toward the mesh 31 from above, that is, toward the first surface 311 from the first surface 311 side. Thereby, as shown in FIGS. 3 and 4, the defibrated material M3 can be supplied and deposited on the first surface 311 of the mesh 31.

The first ejection port 41 is installed away from the first surface 311 of the mesh 31. Thereby, the defibrated material M4 deposited on the first surface 311 of the mesh 31 can move as the mesh 31 rotates.

As shown in FIG. 4, the first ejection port 41 has a shape where an opening surface thereof extends along the circumferential direction of the mesh 31. That is, the first ejection port 41 has a shape having a circular arc 411 located on the center side of the mesh 31, a circular arc 412 closer to the outer peripheral side of the circular arc 411, and a line segment 413 and a line segment 414 which couple the ends of the circular arcs to each other, in plan view of the opening surface of the first ejection port. The circular arc 411 and the circular arc 412 are provided in the circumferential direction of the mesh 31, and the circular arc 412 is longer than the circular arc 411. Further, the line segment 413 is disposed downstream in the rotation direction of the mesh 31 with respect to the line segment 414, and is provided in the radial direction of the mesh 31.

By supplying the defibrated material M3 from the first ejection port 41 having such a shape onto the first surface 311 of the mesh 31, the defibrated material M3 can be supplied and deposited in the rotation direction of the mesh 31.

The detection unit 34 detects the mixing amount of foreign matter in the defibrated material M4. As the detection unit 34, for example, a transmissive or reflective optical sensor can be used. In the present embodiment, the detection unit 34 is located on the first surface 311 side of the mesh 31 and in front of the first ejection unit 4 in the rotation direction of the mesh 31. The detection unit 34 is electrically coupled to the control unit 28, and information on the mixing amount of foreign matter detected by the detection unit 34 is converted into an electrical signal and the electrical signal is transmitted to the control unit 28. The information can be used to adjust various separation conditions, for example.

The first suction unit 5 is provided on the second surface 312 side of the mesh 31 and on the opposite side of the first ejection unit 4 via the mesh 31. The first suction unit 5 has a first suction port 51, and is installed at a position where the first suction port 51 overlaps the first ejection port 41 when viewed from the direction of the central axis O of the mesh 31. The first suction unit 5 is coupled to the blower 262 via a pipe 245, and air can be sucked from the first suction port 51 by the operation of the blower 262. Further, the collection unit 27 composed of, for example, a filter is provided upstream of the pipe 245 from the blower 262. Thereby, the fiber or the foreign matter sucked by the first suction unit 5 can be captured and collected.

The first suction port 51 is installed away from the second surface 312 of the mesh 31. Thereby, it is possible to prevent the suction force of the first suction unit 5 from inhibiting the rotation of the mesh 31, which contributes to the smooth rotation of the mesh 31.

The first suction port 51 has a shape where an opening surface thereof extends along the circumferential direction of the mesh 31. That is, the first suction port 51 has a shape having a circular arc 511 located on the center side of the mesh 31, a circular arc 512 closer to the outer peripheral side than the circular arc 511, and a line segment 513 and a line segment 514 which couple the ends of the circular arcs to each other, in plan view of the opening surface of the first suction port 51. The circular arc 511 and the circular arc 512 are provided in the circumferential direction of the mesh 31, and the circular arc 512 is longer than the circular arc 511. Further, the line segment 513 is disposed downstream in the rotation direction of the mesh 31 with respect to the line segment 514, and is provided in the radial direction of the mesh 31.

In other words, the first suction port 51 which is a suction port has a portion where an opening width increases from the center portion of the mesh toward the outer peripheral side thereof. The defibrated material M3 or the defibrated material M4 on the mesh 31 moves at a higher movement speed in the circumferential direction of the mesh 31 as it goes to the outer peripheral side of the mesh 31. However, with the above configuration, the defibrated material M3 or the defibrated material M4 can be sufficiently sucked even on the outer peripheral side. Note that, the opening width in this case refers to the length in the direction along the circular arc 511 or the circular arc 512.

By supplying the defibrated material M3 from the first suction port 51 having such a shape onto the first surface 311 of the mesh 31, the defibrated material M3 deposited in the rotation direction of the mesh 31 can be sucked via the mesh 31. Therefore, suction can be performed according to the shape of the deposit of the defibrated material M3 deposited on the mesh 31, and the removal of foreign matter and the removal of short fibers in the defibrated material M3 can be performed uniformly.

The second ejection unit 6 is provided on the second surface 312 side of the mesh 31 and is installed on the downstream in the rotation direction of the mesh 31 with respect to the first suction unit 5. In the present embodiment, as shown in FIG. 1, the second ejection unit 6 is installed on the left side of the central axis O of the mesh 31 when viewed from the −y axis side toward the +y axis side. The second ejection unit 6 has a second ejection port 61 at a position facing the second surface 312 of the mesh 31. The second ejection unit 6 is coupled to the blower 263 via a pipe 243, and an air flow can be generated by the operation of the blower 263 and the air can be ejected from the second ejection port 61. Further, the second ejection port 61 ejects the air from the second surface 312 side of the mesh 31 toward the defibrated material M4 on the first surface 311 via the mesh 31. Thereby, the defibrated material M4 on the mesh 31 can be peeled from the first surface 311 of the mesh 31. Accordingly, collection of the defibrated material M4 can be effectively performed by suction by the second suction unit 7 which will be described later.

The second ejection port 61 is installed away from the second surface 312 of the mesh 31. Thereby, it is possible to prevent the second ejection unit 6 from coming into contact with the support member 32, for example.

The second ejection port 61 has a shape where an opening surface thereof curves along the circumferential direction of the mesh 31. That is, the second ejection port 61 has a shape having a circular arc 611 located on the center side of the mesh 31, a circular arc 612 closer to the outer peripheral side than the circular arc 611, and a line segment 613 and a line segment 614 which couple the ends of the circular arcs to each other, in plan view of the opening surface of the second ejection port 61. The circular arc 611 and the circular arc 612 are provided in the circumferential direction of the mesh 31, and the circular arc 612 is longer than the circular arc 611. Further, the line segment 613 is disposed downstream in the rotation direction of the mesh 31 with respect to the line segment 614, and is provided in the radial direction of the mesh 31.

By ejecting the air from the second ejection port 61 having such a shape toward the defibrated material M4 on the mesh 31, the defibrated material M4 can be peeled and separated from the mesh 31 in the rotation direction of the mesh 31.

The second suction unit 7 is provided on the first surface 311 side of the mesh 31 and is installed on the downstream in the rotation direction of the mesh 31 with respect to the first ejection unit 4. The second suction unit 7 has a second suction port 71 at a position facing the first surface 311 of the mesh 31, and is installed at a position where the second suction port 71 overlaps the second ejection port 61 when viewed from the direction of the central axis O of the mesh 31. The second suction unit 7 is coupled to the downstream end of the pipe 172 of the mixing unit 17. Further, the air flow is generated by the operation of the blower 173 provided in the middle of the pipe 172, and suction can be performed from the second suction port 71. Thereby, the defibrated material M4 peeled off from the mesh 31 by the second ejection unit 6 can be sucked and collected, and the defibrated material M4 can be sent out to the downstream, that is, the mixing unit 17.

The second suction port 71 is installed away from the first surface 311 of the mesh 31. Thereby, it is possible to prevent the suction force of the second suction unit 7 from inhibiting the rotation of the mesh 31, which contributes to the smooth rotation of the mesh 31.

The second suction port 71 has a shape where an opening surface thereof curves along the circumferential direction of the mesh 31. That is, the second suction port 71 has a shape having a circular arc 711 located on the center side of the mesh 31, a circular arc 712 closer to the outer peripheral side than the circular arc 711, and a line segment 713 and a line segment 714 which couple the ends of the circular arcs to each other, in plan view of the opening surface of the second suction port 71. The circular arc 711 and the circular arc 712 are provided in the circumferential direction of the mesh 31, and the circular arc 712 is longer than the circular arc 711. Further, the line segment 713 is disposed downstream in the rotation direction of the mesh 31 with respect to the line segment 714, and is provided in the radial direction of the mesh 31.

By sucking the defibrated material M4 on the mesh 31 from the second suction port 71 having such a shape, the defibrated material M4 can be collected in the rotation direction of the mesh 31.

In this way, the second suction unit 7 functions as a collection suction unit that sucks and collects the defibrated material M4 that is a material deposited on the first surface 311 of the mesh 31. The collection by suction is performed, so that the defibrated material M4 can be collected without contact, and damage to the defibrated material M4 can be reduced.

By such a separation device 1, the defibrated material M3 becomes the defibrated material M4 which contains a fiber equal to or longer than a desired length and from which foreign matter is removed, and can be transported downstream to manufacture the sheet S with high quality.

Further, a deviation angle between the center of the first ejection port 41 and the center of the second suction port 71 and a deviation angle between the center of the first suction port 51 and the center of the second suction port 71 are preferably 90° or more and 270° or less, and more preferably 135° or more and 225° or less. Thereby, the opening areas of the first ejection port 41, the first suction port 51, the second ejection port 61, and the second suction port 71 can be sufficiently ensured, and even when the air flow and material passing through the first ejection port 41 are at a high temperature, it is difficult for heat to be transferred to a suction port 72, and heat transfer to the downstream can be prevented. Further, even when the temperature of the defibrated material M3 ejected from the first ejection port 41 is relatively high, heat can be sufficiently dissipated until the defibrated material is collected at the second suction port 71.

Here, for example, when the suction force of the first suction unit 5 is set to be relatively strong, the defibrated material M3 or the defibrated material M4 becomes an excessively adhered state on the first surface 311 of the mesh 31. That is, even if the rotating member 3 rotates, the defibrated material M3 or the defibrated material M4 remains in place in a state of being sucked, and there is a possibility that the mesh 31 may spin in vain. Due to this spinning-in-vain of the mesh 31, the defibrated material M4 is not transported to the second ejection unit 6 and the second suction unit 7, and the defibrated material M4 cannot be smoothly collected.

In view of such a problem, in the present disclosure, as shown in FIGS. 5 and 6, it is configured so that the connecting portion 323 in the rotating member 3 is located on the first surface 311 of the mesh 31, and protrudes upward from the first surface 311 on which the defibrated material M3 or the defibrated material M4 is deposited. That is, the connecting portion 323 functions as a protruding member provided to protrude from the first surface 311 toward the first ejection unit 4 and the second suction unit 7. Thereby, as the rotating member 3 rotates, the connecting portion 323 comes into contact with the defibrated material M4 on the first surface 311 of the mesh 31, and can forcibly move the defibrated material M4 to the downstream in the rotation direction. Therefore, the spinning-in-vain of the mesh as described above can be prevented, and the defibrated material M4 can be smoothly transported to the second ejection unit 6 and the second suction unit 7. As a result, the defibrated material M4 can be smoothly collected regardless of the suction force of the first suction unit 5.

Further, as described above, the connecting portion 323 as a protruding member is a long member extending across the mesh 31 from a center portion to an outer peripheral portion. Thereby, as described above, the effect of forcibly moving the defibrated material M4 forward in the rotation direction can be exerted over substantially the entire area of the mesh 31. Therefore, the defibrated material M4 can be smoothly collected with higher accuracy. Further, by supporting the mesh 31 with the connecting portion 323, deformation and breakage of the mesh 31 can be reduced with respect to the stress applied to the mesh 31.

The plurality of connecting portions 323 as protruding members are provided in the circumferential direction of the mesh 31. Thereby, even when the defibrated material M3 is continuously supplied from the first ejection unit 4, as described above, the effect of forcibly moving the defibrated material M4 forward in the rotation direction can be exerted.

Further, the thickness of the connecting portion 323, that is, the width of the mesh 31 in plan view is not particularly limited, but is preferably 1 mm or more and 20 mm or less, and more preferably 2 mm or more and 15 mm or less. Thereby, in a state where the first ejection port 41, the first suction port 51, the second ejection port 61, or the second suction port 71 overlaps the connecting portion 323 in plan view of the mesh 31, inhibition of ejection or suction can be effectively suppressed.

For the same reason, a ratio S1'/S1 between a maximum area S1' of the portion where the first ejection port 41 and the connecting portion 323 overlap in plan view of the mesh 31 and an opening area S1 of the first ejection port 41 is preferably 0.01 or more and 0.99 or less, and more preferably 0.01 or more and 0.50 or less.

Further, for the same reason, a ratio S2'/S2 between a maximum area S2' of the portion where the first suction port 51 and the connecting portion 323 overlap in plan view of the mesh 31 and an opening area S2 of the first suction port 51 is preferably 0.01 or more and 0.99 or less, and more preferably 0.01 or more and 0.50 or less.

For the same reason, a ratio S3'/S3 between a maximum area S3' of the portion where the second ejection port 61 and the connecting portion 323 overlap in plan view of the mesh 31 and an opening area S3 of the second ejection port 61 is preferably 0.01 or more and 0.99 or less, and more preferably 0.01 or more and 0.50 or less.

For the same reason, a ratio S4'/S4 between a maximum area S4' of the portion where the second suction port 71 and the connecting portion 323 overlap in plan view of the mesh 31 and an opening area S4 of the second suction port 71 is preferably 0.01 or more and 0.99 or less, and more preferably 0.01 or more and 0.50 or less.

As described above, the separation device 1 according to the present disclosure includes the rotating member 3 that has the mesh 31 having the first surface 311 and the second surface 312 in a front and back relationship and the connecting portion 323 as a protruding member provided on the first surface 311 side of the mesh 31, the first ejection unit 4 as a supply unit that supplies the defibrated material M3 as a material containing a fiber onto the first surface 311 of the mesh 31, the first supply unit 5 as a suction unit that is provided on the second surface 312 side of the mesh 31 and configured to suck a part of the defibrated material M3 supplied onto the first surface 311, and the second ejection unit 6 and the second suction unit 7 as a collection unit that collects the defibrated material M3 deposited on the first surface 311. Thereby, as the rotating member 3 rotates, the connecting portion 323 comes into contact with the defibrated material M4 on the first surface 311 of the mesh 31, and can forcibly move the defibrated material M4 forward in the rotation direction. Therefore, the spinning-in-vain of the mesh as described above can be prevented, and the defibrated material M4 can be smoothly transported to the second ejection unit 6 and the second suction unit 7. As a result, the defibrated material M4 can be smoothly collected regardless of the suction force of the first suction unit 5.

Further, the fiber body deposition apparatus 10 includes the separation device 1 and the web forming unit 19 as a deposition unit that deposits the defibrated material M4 that is a material collected by the second ejection unit 6 and the second suction unit 7 as a collection unit to form the web M8. Thereby, the sheet S can be manufactured appropriately and efficiently while taking the advantages of the separation device 1 described above.

Second Embodiment

Figure 7:
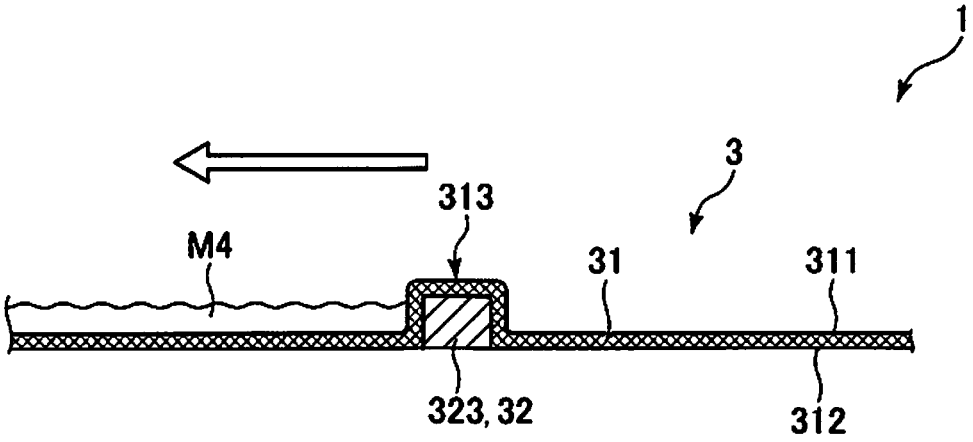
FIG. 7 is a cross-sectional view showing a rotating member of a separation device according to a second embodiment of the present disclosure.
Figure 8:
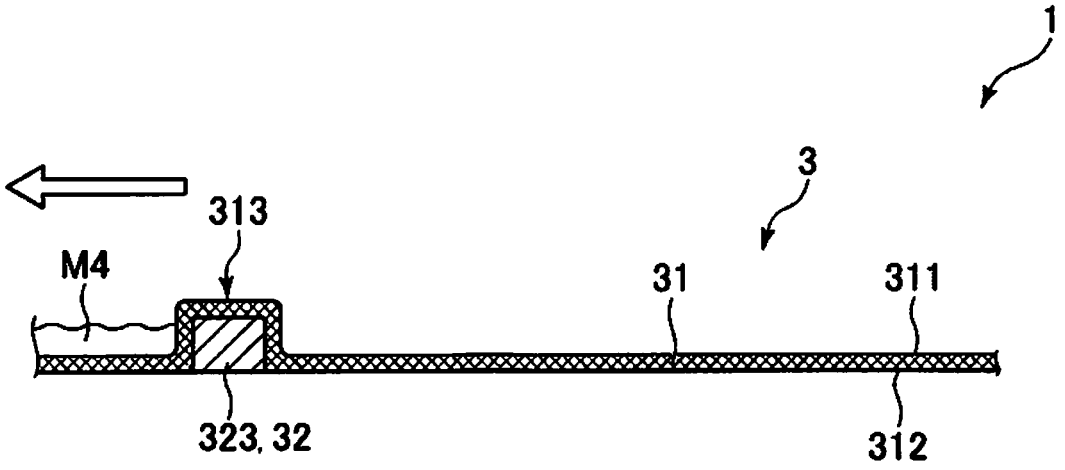
FIG. 8 is a cross-sectional view showing the rotating member of the separation device according to the second embodiment of the present disclosure.

FIGS. 7 and 8 are cross-sectional views showing a rotating member of a separation device according to a second embodiment of the present disclosure.

The separation device and the fiber body deposition apparatus according to the second embodiment of the present disclosure will be described below with reference to FIGS. 7 and 8, but the description will focus on the differences from the above-described embodiment, and the description of the same matters will not be repeated.

As shown in FIGS. 7 and 8, in the present embodiment, the support member 32 is provided on the second surface 312 side of the mesh 31 and supports the mesh 31 from the second surface 312 side. Further, the connecting portion 323 is disposed so as to protrude above the second surface 312 of the mesh 31, that is, toward the first surface 311 side. Therefore, the mesh 31 has a portion raised by the connecting portion 323, that is, a portion 313 protruding toward the first surface 311 side. Also according to the present embodiment, the effects of the present disclosure described in the first embodiment can be obtained.

As described above, the separation device 1 includes the rotatable rotating member 3 that has the mesh 31 having the first surface 311 and the second surface 312 in a front and back relationship and the connecting portion 323 as a protruding member provided on the second surface 312 side of the mesh 31 and causing the mesh 31 to protrude toward the first surface 311 side, the first ejection unit 4 as a supply unit that supplies the defibrated material M3 as a material containing a fiber onto the first surface 311 of the mesh 31, the first suction unit 5 as a suction unit that is provided on the second surface 312 side of the mesh 31 and sucks a part of the defibrated material M3 supplied onto the first surface 311, and the second ejection unit 6 and the second suction unit 7 as a collection unit that collects the defibrated material M3 deposited on the first surface 311. Thereby, as the rotating member 3 rotates, the portion 313 protruding from the connecting portion 323 can forcibly move the defibrated material M4 on the first surface 311 of the mesh 31 to the downstream in the rotation direction. Therefore, the spinning-in-vain of the mesh 31 as described in the first embodiment can be prevented, and the defibrated material M4 can be smoothly transported to the second ejection unit 6 and the second suction unit 7. As a result, the defibrated material M4 can be smoothly collected regardless of the suction force of the first suction unit 5.

Third Embodiment

Figure 9:
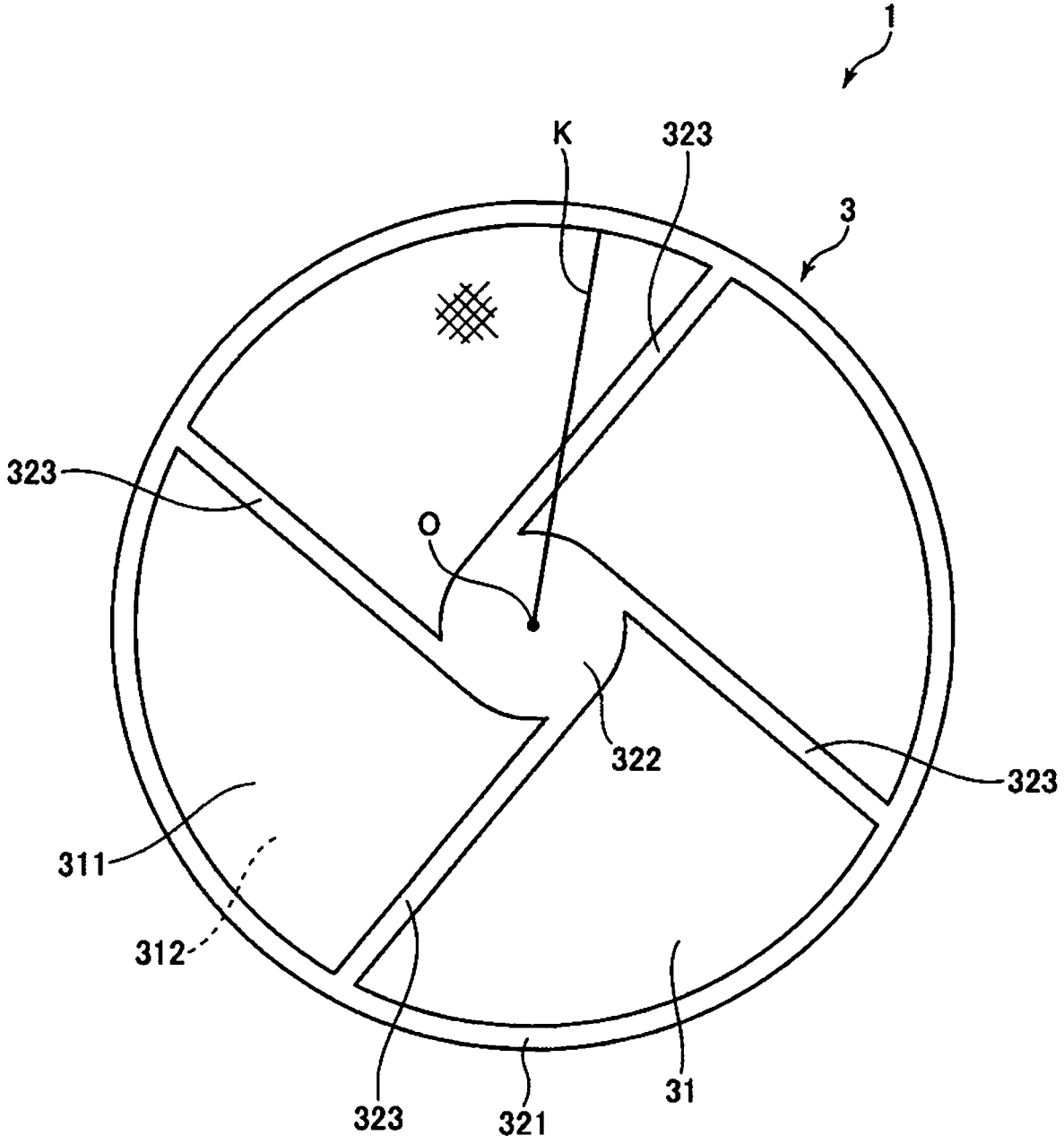
FIG. 9 is a plan view showing a rotating member of a separation device according to a third embodiment of the present disclosure.

FIG. 9 is a plan view showing a rotating member of a separation device according to a third embodiment of the present disclosure.

The separation device and the fiber body deposition apparatus according to the third embodiment of the present disclosure will be described below with reference to FIG. 9, but the description will focus on the differences from the above-described embodiment, and the description of the same matters will not be repeated.

As shown in FIG. 9, the connecting portion 323 as a protruding member has a linear shape in plan view and is inclined with respect to the radial direction of the mesh 31. More specifically, when an imaginary line K connecting the central axis O and the outer peripheral portion of the mesh 31 is drawn along the radial direction so as to be in contact with the connecting portion 323, the connecting portion 323 is inclined so that the outer peripheral side of the mesh 31 is located downstream of the central support portion 322 in the rotation direction. Thereby, it is possible to prevent the defibrated material M4 moved by the connecting portion 323 from moving to the outer peripheral side of the mesh 31. Therefore, the defibrated material M4 can be collected with higher accuracy. The shape of the connecting portion 323 is not limited to the shape of illustration, for example, the configuration in which a part of connecting portion 323 is inclined with respect to the radial direction of the mesh 31 may be applied.

The angle formed by the connecting portion 323 and the radial direction of the mesh 31 is not particularly limited, for example, the angle is preferably 1° or more and 30° or less, and more preferably 5° or more and 20° or less. Thereby, the above effect can be more reliably achieved.

Fourth Embodiment

Figure 10:
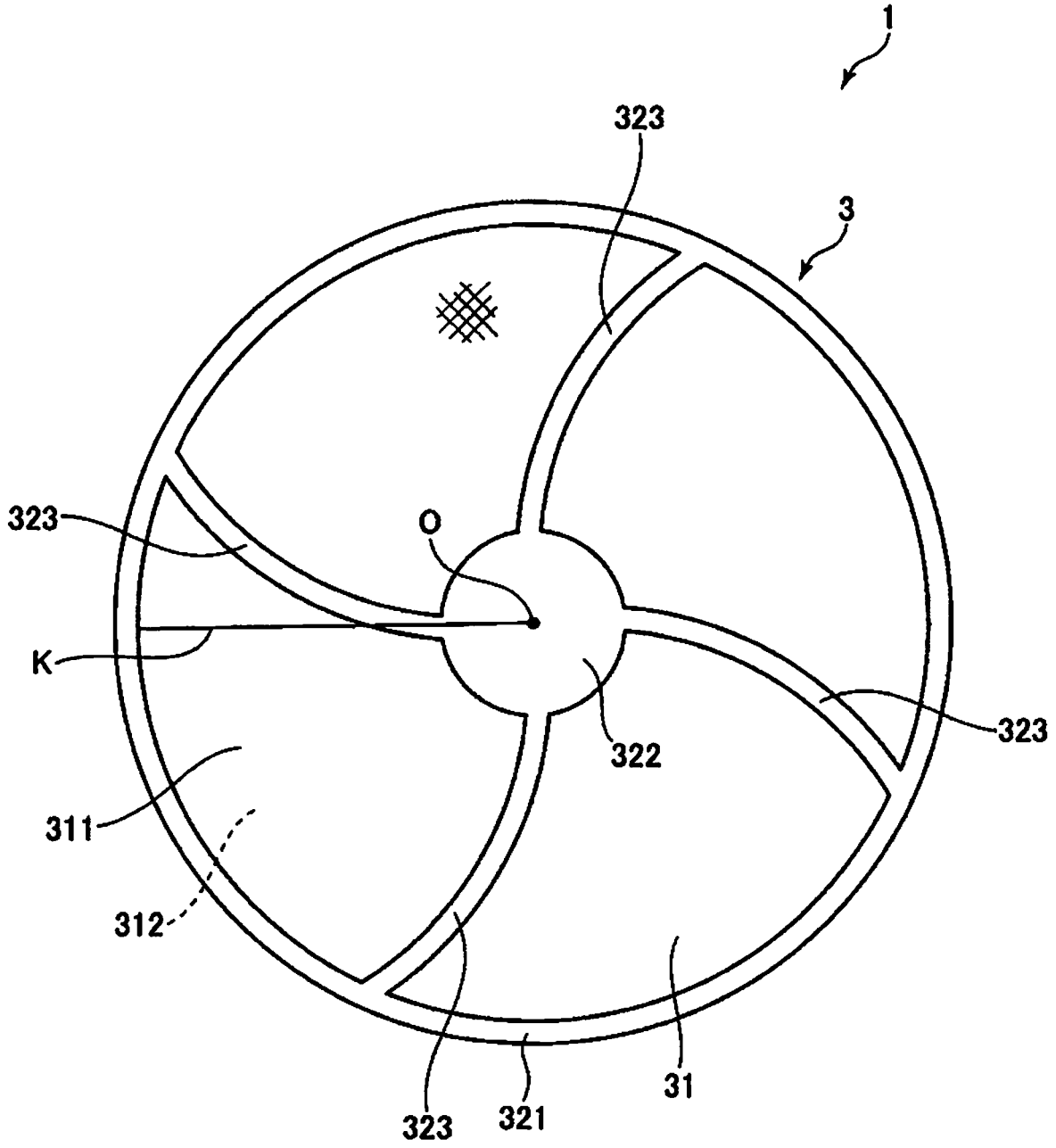
FIG. 10 is a plan view showing a rotating member of a separation device according to a fourth embodiment of the present disclosure.

FIG. 10 is a plan view showing a rotating member of a separation device according to a fourth embodiment of the present disclosure.

The separation device and the fiber body deposition apparatus according to the fourth embodiment of the present disclosure will be described below with reference to FIG. 10, but the description will focus on the differences from the above-described embodiment, and the description of the same matters will not be repeated.

As shown in FIG. 10, in the present embodiment, the connecting portion 323 has a shape that is curved in one direction, and specifically, the connecting portion 323 protrudes with respect to the first surface 311 and when viewed from the central support portion 322 side toward the frame body 321, the connecting portion 323 is curved toward the upstream and then is curved toward the downstream with respect to the rotation direction of the mesh 31. Thereby, since the defibrated material M4 can be moved so as to capture the defibrated material M4 at the connecting portion 323, it is possible to more effectively prevent the defibrated material M4 moved by the connecting portion 323 from moving to the outer peripheral side of the mesh 31.

Hereinbefore, the separation device and the fiber body deposition apparatus according to the present disclosure have been described with reference to the illustrated embodiment, but the present disclosure is not limited thereto and each unit constituting the separation device and the fiber body deposition apparatus can be replaced with any unit that can implement the same function.

Further, any components may be added. Although the connecting portion 323 is shown as the protruding member, the protruding member may not necessarily connect the central support portion 322 and the frame body 321 to each other. It is sufficient that at least one protruding member is provided when the mesh 31 is viewed in plan view. Further, the protruding members may be arranged separately on the mesh 31.

The separation device and the fiber body deposition apparatus according to the present disclosure may be a combination of any two or more configurations or features of the above embodiments.

Note that, in the above embodiments, the mesh has a circular shape in plan view and rotates around the central axis, but the present disclosure is not limited thereto. For example, the mesh includes an endless belt, and may be configured to be wound around a plurality of rollers to rotate around the rollers in a circular manner.

In the description of the above embodiments, the first ejection port, the first suction port, the second ejection port, and the second suction port each have a curved shape surrounded by two circular arcs and two straight lines, but the present disclosure is not limited thereto. For example, any shape such as a rectangle, a polygon, or a circle may be used.

Further, the first ejection port, the first suction port, the second ejection port, and the second suction port may have a plurality of openings. In this case, it is preferable that the number of openings increases as going to the outer peripheral side of the mesh.

The shapes of the first ejection port, the first suction port, the second ejection port, and the second suction port are not limited to the illustrated configuration, and any shape may be used. However, when the opening is divided by a circular arc passing through the midpoint of the opening surface in the radial direction of the mesh, the outer peripheral portion preferably has a larger area than the inner peripheral portion. The circular arc referred to here is a curvature along the outer edge of the mesh.

What is claimed is:

1. A separation device comprising:

a rotating member that has a mesh having a first surface and a second surface in a front and back relationship and a protruding member that is provided on the first surface side of the mesh and rotates integrally with the mesh, the mesh having a circular shape in a plan view and rotating around a central axis of the circular shape, the protruding member directly contacting the first surface and protruding from the first surface in a direction along the central axis, the protruding member being an elongated member extending across the mesh from a center portion of the mesh to an outer peripheral portion of the mesh;

a supply unit that supplies a material containing a fiber onto the first surface of the mesh;

a suction unit that is provided on the second surface side of the mesh and configured to suck a part of the material supplied onto the first surface; and a collection unit that collects the material deposited on the first surface.

2. The separation device according to claim 1, wherein at least a part of the protruding member is inclined with respect to a radial direction of the mesh when an imaginary line connecting the central axis and the outer peripheral portion is drawn so as to be in contact with the protruding member.

3. The separation device according to claim 2, wherein the protruding member is provided so that the outer peripheral portion of the mesh is positioned downstream in a rotation direction with respect to the center portion of the mesh.

4. The separation device according to claim 1 wherein a plurality of the protruding members is provided on the mesh.

5. The separation device according to claim 4, wherein the suction unit has a suction port, and the suction port has a portion where an opening width increases from the center portion of the mesh toward the outer peripheral side thereof.

6. The separation device according to claim 1, wherein the collection unit has a collection suction unit that sucks and collects the material deposited on the first surface.

7. A fiber body deposition apparatus comprising:

the separation device according to claim 1; and a deposition unit that is disposed downstream relative to the separation device in a transport direction of the material and deposits the material collected by the collection unit to form a web.

8. A separation device comprising:

a rotatable rotating member that has a mesh having a first surface and a second surface in a front and back relationship and a protruding member provided on the second surface side of the mesh and causing the mesh to protrude toward the first surface side;

a supply unit that supplies a material containing a fiber onto the first surface of the mesh;

a suction unit that is provided on the second surface side of the mesh and sucks a part of the material supplied onto the first surface; and a collection unit that collects the material deposited on the first surface.

* * * * *